US006495811B2

(12) United States Patent
Nitsche et al.

(10) Patent No.: US 6,495,811 B2
(45) Date of Patent: Dec. 17, 2002

(54) INDUCTION HEATING DEVICE AND METHOD, AND PROCESSOR

(75) Inventors: Werner Nitsche, Unterhaching (DE); Wolfram Betzold, Hohenkirchen (DE); Friedrich Stumpf, Munich (DE)

(73) Assignee: AGFA-Gevaert AG, Leverkusen (DE)

( * ) Notice: Subject to any disclaimer, the term of this patent is extended or adjusted under 35 U.S.C. 154(b) by 0 days.

(21) Appl. No.: 10/014,986

(22) Filed: Dec. 11, 2001

(65) Prior Publication Data

US 2002/0056711 A1 May 16, 2002

(30) Foreign Application Priority Data

Dec. 11, 2000 (DE) ..... 100 65 935

(51) Int. Cl.[7] ..... H05B 6/14

(52) U.S. Cl. ..... 219/619; 219/656; 219/670; 219/674; 219/667; 399/328; 399/330

(58) Field of Search ..... 219/619, 656, 219/670, 672, 674, 663, 665, 667; 399/328, 330

(56) References Cited

U.S. PATENT DOCUMENTS

| | | | | | |
|---|---|---|---|---|---|
| 4,447,690 | A | * | 5/1984 | Grever | 219/643 |
| 5,553,729 | A | | 9/1996 | Kitano et al. | |
| 5,990,461 | A | | 11/1999 | Stumpf et al. | |
| 6,043,471 | A | * | 3/2000 | Wiseman et al. | 219/662 |
| 6,188,054 | B1 | * | 2/2001 | Ohta | 219/663 |
| 6,320,168 | B1 | * | 11/2001 | Kimata et al. | 299/330 |
| 2002/0011485 | A1 | * | 1/2002 | Suzuki | 219/619 |

FOREIGN PATENT DOCUMENTS

| | | | | |
|---|---|---|---|---|
| DE | 40 11 825 C2 | | 3/1992 | |
| DE | 195 32 044 A1 | | 3/1996 | |
| JP | 3-167777 | * | 7/1991 | 219/672 |

* cited by examiner

*Primary Examiner*—Philip H. Leung
(74) *Attorney, Agent, or Firm*—John A. Merecki; Hoffman, Warnick & D'Alessandro

(57) ABSTRACT

An induction heating device having a hollow cylindrical body made of electrically conductive material, at least one primary induction coil and at least one auxiliary induction coil, the at least one primary induction coil and the at least one auxiliary induction coil being arranged in the cavity of the cylindrical body such that, by means of the at least one primary induction coil and the at least one auxiliary induction coil, first and second magnetic fields, respectively, can be produced in the cylindrical body. The at least one auxiliary induction coil and the at least one primary induction coil operate such that the second magnetic field, at least in one area of the cylindrical body, counteracts the first magnetic field. A corresponding method of operating such an induction heating device, and also a processor for processing a recording medium, having such an induction heating device, are also provided.

11 Claims, 3 Drawing Sheets

INDUCTION HEATING DEVICE AND METHOD, AND PROCESSOR

FIELD OF THE INVENTION

The present invention relates to an induction heating device having a hollow cylindrical body made of electrically conductive material, at least one primary induction coil and at least one auxiliary induction coil, the at least one primary induction coil and the at least one auxiliary induction coil being arranged in the cavity of the cylindrical body in such a way that, by means of the at least one primary induction coil, a first magnetic field can be produced in the cylindrical body and, by means of the at least one auxiliary induction coil, a second magnetic field can be produced in the cylindrical body. It relates moreover to a method of operating an induction heating device, which comprises a hollow cylindrical body made of electrically conductive material, at least one primary induction coil and at least one auxiliary induction coil, the primary induction coil and the at least one auxiliary induction coil being arranged in the cavity of the cylindrical body, in which method, firstly, by means of the at least one primary induction coil, a first magnetic field is produced in the cylindrical body and, by means of the at least one auxiliary induction coil, a second magnetic field is produced in the cylindrical body.

BACKGROUND OF THE INVENTION

DE 195 32 044 discloses a device and method, in which, in addition to a primary induction coil for heating the cylindrical body, induction auxiliary coils are used which are intended to serve to prevent the production of a gap between the cylindrical body and connecting sections or to maintain the circular shape of the cylindrical body. To this end, before the actual commissioning, the auxiliary induction coils in the edge regions of the cylindrical body are used to reinforce the magnetic field produced by the primary induction coil. The time which is required until the surface temperature distribution on the cylindrical body is stabilized is shortened thereby. After the cylindrical body has been heated uniformly to the desired temperature, the supply to the auxiliary induction coils is switched off. According to the version represented in DE 195 32 044, after the uniform heating, the supply by the primary induction coil is on its own sufficient to ensure thermal equilibrium.

U.S. Pat. No. 5,990,461 discloses a thermal processor, in which a photothermographic film can be developed by means of a heated cylindrical body, a heating lamp being used as a heat source. A use of the induction heater described in DE 195 32 044 as a substitute for the heating lamp does not lead to any satisfactory result; the temperature distribution which results along the longitudinal axis of the cylindrical body during operation would lead to temperature differences on the area of the surface of the cylindrical body, on which the photothermographic film rests for development, said differences lying outside a tolerance band which would be permitted for the development of materials of this type. By means of comparative measurements, it was established that the temperature drop toward the ends of the cylindrical body during operation, that is to say after the auxiliary induction coils had been switched off, was about 20%, starting from the temperature in the central region of the cylindrical body. This would not be a problem if the cylindrical body were to be configured to be wide enough and the recording material to be developed were to be transported only in the central region of the cylindrical body, in which the temperature is sufficiently constant. With regard to the most compact device possible, however, it is desirable to make the length of the cylindrical body as short as possible.

SUMMARY OF THE INVENTION

It is therefore the object of the present invention to make possible a temperature distribution on the surface of a cylindrical body which, with a compact design, meets the requirements placed on the thermal development of a recording medium.

In the sense of the present invention, recording medium is to be understood in particular to mean material which can be developed by the thermal route, for example photothermographic material or thermographic material. In particular, it can be a film for radiographic applications.

The invention is based on the finding that the temperature distribution along the cylindrical body may be controlled very precisely if the two magnetic fields, which are produced firstly by the at least one primary induction coil and secondly by the at least one auxiliary induction coil, weaken each other. As a result, in the areas of the surface of the cylindrical body in which excessively high temperatures are produced in the cylindrical body because of the primary induction coil, the energizing magnetic field can be specifically reduced, in order as a result to arrive at a uniform temperature profile. By means of this measure, temperature profiles along the longitudinal axis of the cylindrical body on the outer surface of the cylindrical body can be achieved at which a deviation of only 2% or less results over 80% or more of the length of the cylindrical body. It is therefore possible for processors with induction heating devices to be implemented which can be used for the development of recording material even for highly sensitive applications, for example radiographic applications in medicine. In particular in this area, it is completely unacceptable if there is a risk of misdiagnosis as a result of non-uniform development.

As opposed to the induction heating device of DE 195 32 044, in the case of the induction heating device according to the invention, the operation of the auxiliary induction coils is possible independently of the preheating of the induction heating device during actual operation.

In a first embodiment, the cylindrical body has a longitudinal axis, and at least one primary induction coil is arranged parallel to this longitudinal axis. By using the at least one primary induction coil, a magnetic field that is homogeneous over its longitudinal extent can be produced. At least one auxiliary induction coil is arranged in the area of a central section of the primary induction coil. In this embodiment, the primary induction coil is dimensioned such that it generates the temperature necessary for the development in the edge regions of the cylindrical body. This would lead to an excessively high temperature in the central region of the cylindrical body, but this is reduced by the auxiliary induction coil arranged there.

In another embodiment, the cylindrical body likewise has a longitudinal axis. The at least one primary induction coil is again arranged parallel to this longitudinal axis, but it is now possible, by using the at least one primary induction coil, to produce a magnetic field that is inhomogeneous over its longitudinal extent, being stronger in a first and in a second edge region of the primary induction coil than in a central region. In each case, at least one auxiliary induction coil is arranged in the region of the first and of the second edge region of the primary induction coil. In this embodiment, the temperature in the edge regions of the cylindrical body is kept at the necessary level by the primary induction coil producing a stronger magnetic field there which then, if the temperature becomes too high, can be weakened to the necessary values by the auxiliary induction coils arranged in the edge region.

It is preferable for the at least one auxiliary induction coil to be capable of activation by being short-circuited. This implementation provides the advantage that it is possible to dispense with an additional power supply unit for driving the at least one auxiliary induction coil.

Preferably, a control device can further be provided, in order to activate at least one auxiliary induction coil. The control device can comprise a look-up table, in which the characteristic for the activation of the at least one auxiliary induction coil for at least one load case is stored. By this means, the at least one auxiliary induction coil can be operated with regard to the load case which is currently present, for example start-up of the processor or standby operation. Also stored in such a look-up table are the appropriate drive data for driving the at least one auxiliary induction coil. If a specific look-up table is compiled for a specific induction heating device, a further advantage results from the fact that the production tolerances for this specific induction heating device, in particular the production tolerances for the primary and auxiliary induction coils and for the thickness and coating of the cylindrical body, can be reduced, since deviations can be compensated for electronically by driving the induction coils appropriately.

Preferably, at least one temperature sensor can also be arranged in the area of the cylindrical body, the control device being designed in such a way that it permits the output signal from the at least one temperature sensor to be taken into account when activating the at least one auxiliary induction coil. If temperature sensors with very short response times, for example non-contacting IR sensors, are used, a very uniform temperature distribution may be achieved on the surface of the cylindrical body. Use is preferably made of three temperature sensors, which are arranged in the two edge regions and in the central region of the cylindrical body.

The present invention likewise comprises a processor for processing a recording medium by using an induction heating device according to the invention. A processor of this type preferably also comprises transport means, in order to transport the recording medium through the processor, exposure means, which are arranged relative to a predetermined section of the cylindrical body in order to expose the recording medium as its rests on this section, and also pressing means, in order to press the recording medium against the outer surface of the cylindrical body for its development.

BRIEF DESCRIPTION OF THE DRAWINGS

An exemplary embodiment will be described in more detail below with reference to the appended drawings, in which.

DETAILED DESCRIPTION OF THE INVENTION

Figure 1:
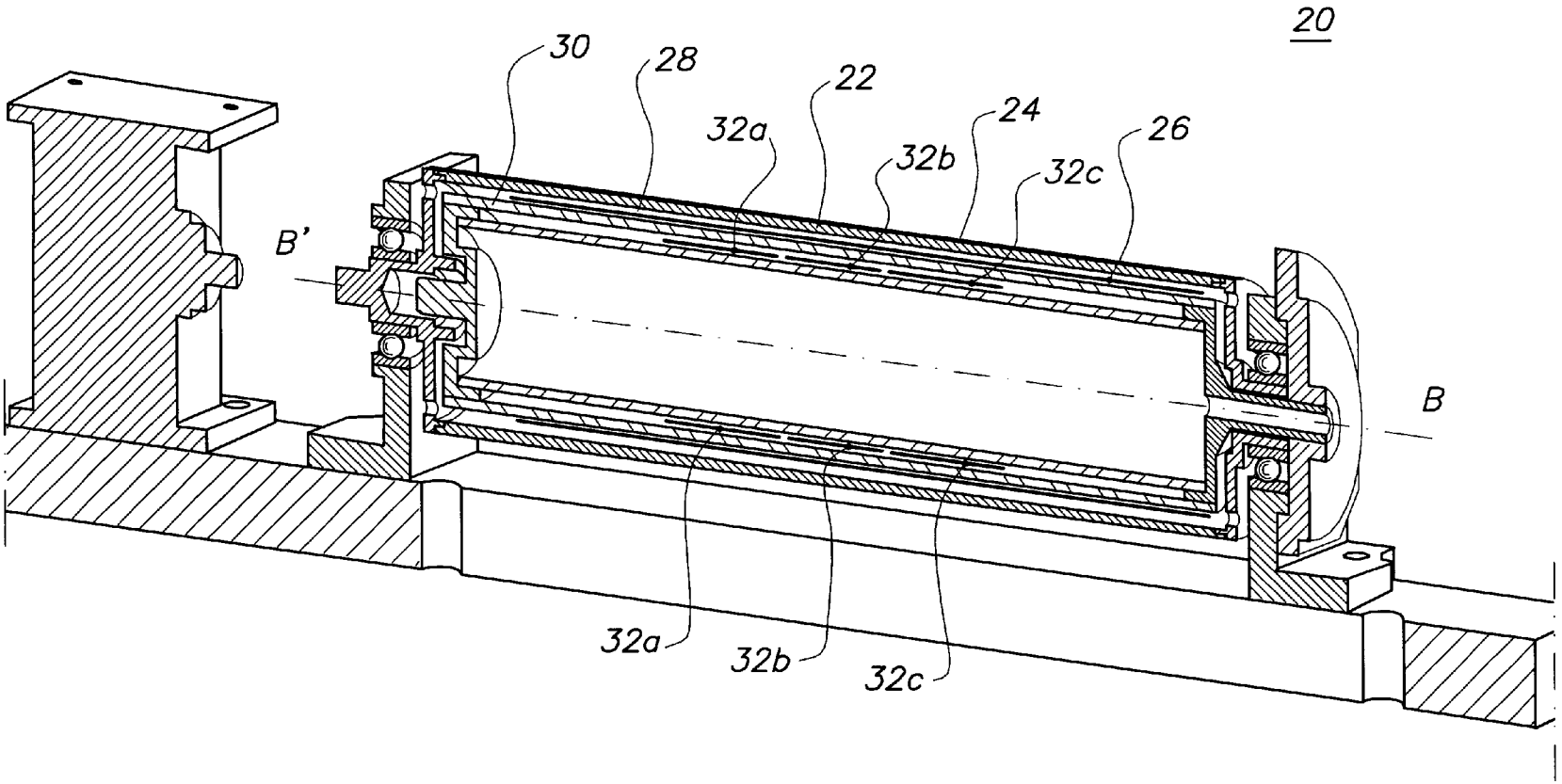
FIG. 1 shows a schematic representation of a longitudinal section through an induction heating device according to the invention, with homogeneous winding of the primary induction coil.

FIG. 1 shows a longitudinal section through an induction heating device 20 according to the invention. It comprises a cylindrical body 22 made of electrically conductive material, by means of which an outer surface 24 is formed, onto which the exposed recording material is pressed, for its thermal development, by pressing means (not illustrated), preferably rollers, brushes and the like. In the induction heating device 20, the cylindrical body 22 is mounted such that it can rotate about its longitudinal axis B'B. Arranged in the cylindrical body 22 is a primary induction coil 26, which can be wound homogeneously (as illustrated) or inhomogeneously (see FIG. 4). The primary induction coil 26 and the cylindrical body 22 form a transformer, the cylindrical body 22 constituting a short-circuited winding. The magnetic field produced by the primary induction coil 26 induces currents in the cylindrical body 22, which lead to development of heat on the surface 24 of the cylindrical body 22. In the case of the homogeneous embodiment, the primary induction coil 26 is formed from windings which consist of the same wire material and are spaced apart equidistantly from one another.

The secondary winding corresponding to the primary induction coil 26 to form a transformer is formed by the cylindrical body 22. An air gap 28 is arranged between the cylindrical body 22 and primary induction coil 26. For the purpose of thermal insulation, an insulating material 30 is applied, and furthermore must be nonmagnetic, for example a material that can be obtained under the name Pertinax.

Arranged in the induction heating device 20, in a central region, are three auxiliary induction coils 32*a*, 32*b*, 32*c*, which can be driven separately and can preferably be activated by being short-circuited.

Figure 2:
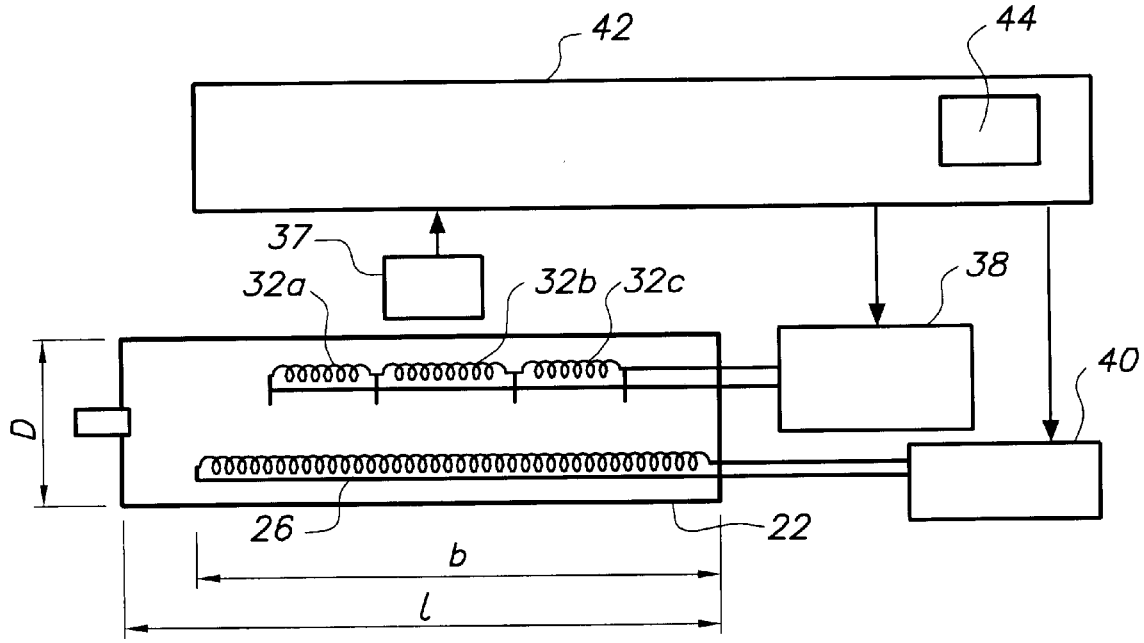
FIG. 2 shows a schematic block circuit representation of a circuit arrangement for operating an induction heating device according to the invention.

FIG. 2 shows a schematic representation of a circuit arrangement for the operation of the induction heating device 20 according to the invention. Components which correspond to components from FIG. 1 are identified with the same reference symbols here. At the bottom left in FIG. 2, first of all the cylindrical body 22 can be seen, in which a primary induction coil 26 and three auxiliary induction coils 32*a*, 32*b*, 32*c* are arranged. Illustrated once more is an exemplary embodiment with a homogeneous primary induction coil 26, that is to say the auxiliary induction coils 32*a* to 32*c* are arranged in a central region of the cylindrical body 22 in such a way that they counteract the magnetic field produced by the primary induction coil 26 in the region of the cylindrical body 22, in particular weaken said magnetic field. Since the primary induction coil 26 is dimensioned such that the desired temperature is established in the edge region of the surface of the cylindrical body 22, one temperature sensor 37, which registers the temperature in the central region of the cylindrical body 22, is sufficient. The induction heating device further comprises a drive circuit 38 for the auxiliary induction coils 32*a* to 32*c*, and a drive circuit 40 for the primary induction coil 26. For their part, the two drive circuits 38, 40 are driven by a control device 42. The control device 42 can comprise a look-up table 44, in which the drive characteristics for various load cases, for example the start-up of the induction heating device and standby operation, are stored. Such characteristics can be determined empirically in advance for a specific induction heating device 20 and stored in the look-up table 44. When a specific load case is present, the primary induction coil 26 and the auxiliary induction coils 32*a* to 32*c* are then driven appropriately. In addition, the control device 42 is supplied with the output signal from the temperature sensor 37, which is taken into account when driving the drive circuits 38, 40. The primary and auxiliary induction coils 26, 32*a* to 32*c* are preferably controlled by means of pulse width modulation.

Figure 3:
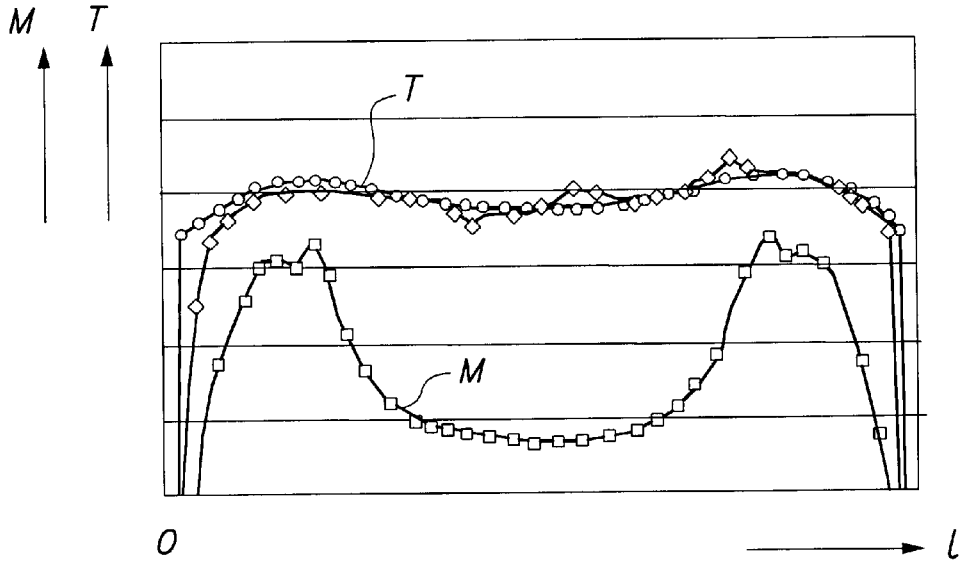
FIG. 3 shows the profile of temperature and magnetic field over the length of the cylindrical body for an induction heating device according to the invention in accordance with FIG. 1.

FIG. 3 represents the profile of temperature T and magnetic field M over the length I of the cylindrical body 22. As this reveals, a temperature profile could be achieved on the surface 24 of the cylindrical body 22 with a deviation of at most 2% over at least 80% of the length I of the cylindrical body 22.

Figure 4:
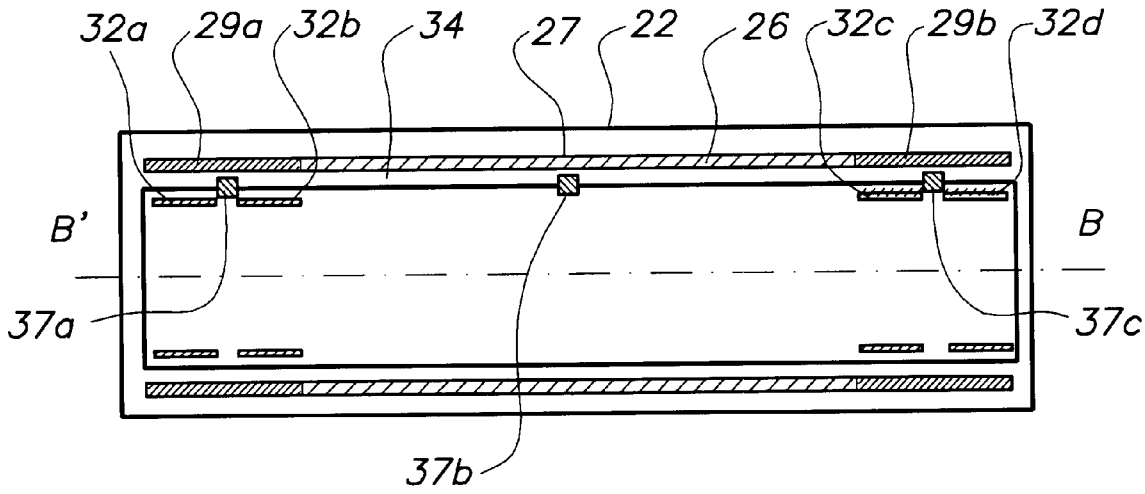
FIG. 4 shows a schematic representation of a longitudinal section through an induction heating device according to the invention, with inhomogeneous winding of the primary induction coil.

The above explanations with regard to the embodiment with a homogeneous primary induction coil 26 apply in a corresponding way to the embodiments with an inhomogeneous primary induction coil 26. To this end, FIG. 4 shows a detail of an induction heating device having an inhomogeneously wound primary induction coil 26, that is to say a primary induction coil 26 which, in a central region 27, has a lower winding density than in the edge regions 29*a* and 29*b*. Associated with the edge regions 29*a* and 29*b* of the primary induction coil 26 in each case are two auxiliary induction coils 32*a* and 32*b* and, respectively, 32*c* and 32*d*, which can be operated in such a way that they weaken the magnetic field produced by the primary induction coil. The embodiment represented in FIG. 4 comprises three temperature sensors 37*a*, 37*b*, 37*c*, which are arranged in the two edge regions and in the central region of the cylindrical body 22.

In a preferred exemplary embodiment with an inhomogeneous primary induction coil 26, the length I of the cylindrical body is 18" in the case of a recording material width b of 14". In a central region, the primary induction coil 26 has 180 turns with double wire spacing and, in the two edge regions, 26 turns with single wire spacing. In order to take account of the fact that the cylindrical body 22 is open on one side and closed on the other side, in one edge region, in the region having 26 turns arranged densely in series in the primary induction coil, there are four auxiliary induction coils each having twelve turns, and in the other edge region there are eight auxiliary induction coils alternately having eight and nine turns. The cylindrical body diameter D is 82 mm, the wrap of recording material around the cylindrical body 22 is 180 degrees. Given a development time for the recording material of 15 seconds, the result is an advance of 8.6 mm/s. The temperature of the cylindrical body 22 is registered at three points via three non-contacting infrared temperature sensors, to be specific at the center and in the two edge regions. The cylindrical body 22 is heated as a function of the temperature in the central region, while the signal from the outer sensors is used to control the driving of the auxiliary induction coils.

Figure 5:
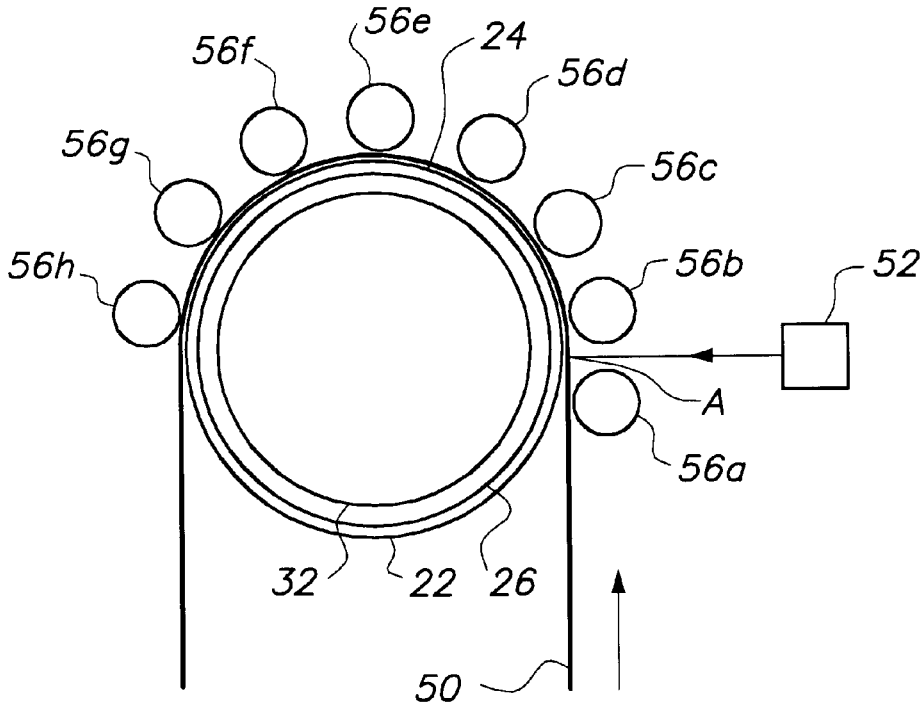
FIG. 5 shows a schematic representation of a processor according to the invention for processing recording medium.

FIG. 5 shows a schematic representation of a processor in which an induction heating device according to the invention is used for the thermal development of recording material. In this processor, a latent image is initially recorded on a recording material 50, for example by using a laser 52. This latent image is subsequently developed by means of the induction heating device. The induction heating device comprises the cylindrical body 22, which is rotatably mounted and can be driven by a drive device (not illustrated). The recording material is exposed at a location A, at which the recording material 50 is pressed firmly onto the outer surface 24 of the cylindrical body 22 by means of two guide rollers 56*a*, 56*b*. Further pressing rollers 56*c* to 56*h* ensure firm contact between the recording material 50 and the outer surface 24 of the cylindrical body 22 during the thermal development process. The primary winding 26 and an auxiliary winding 32 are shown in the interior of the cylindrical body 22.

We claim:

1. Induction heating device having a hollow cylindrical body made of electrically conductive material, at least one primary induction coil and at least one actively controlled auxiliary induction coil, the at least.one primary induction coil and the at least one auxiliary induction coil being arranged in and around the cavity of the cylindrical body in such a way that, by means of the at least one primary induction coil, a first magnetic field can be produced in the cylindrical body and, by means of the at least one auxiliary induction coil, a second magnetic field can be produced in the cylindrical body, wherein the at least one auxiliary induction coil, and the at least one primary induction coil can be operated in such a way that the second magnetic field, at least in one region of the cylindrical body, counteracts the first magnetic field in such a way that the second magnetic field specifically weakens the first magnetic field to maintain a substantially uniform temperature profile on an outer surface of the cylindrical body.

2. Induction heating device according to claim 1, wherein the cylindrical body has a longitudinal axis, and the at least one primary induction coil is arranged parallel to this longitudinal axis and is configured such that, with the at least one primary induction coil, a magnetic field that is homogeneous over its longitudinal extent can be produced, and the at least one auxiliary induction coil, in relation to the longitudinal extent of the primary induction coil, is arranged in a central region of the primary induction coil.

3. Induction heating device according to claim 1, wherein the cylindrical body has a longitudinal axis and the at least one primary induction coil is arranged parallel to this longitudinal axis and is configured such that with the at least one primary induction coil, a magnetic field that is inhomogeneous over its longitudinal extent can be produced, which, in relation to the longitudinal extent of the primary induction coil, is stronger in a first edge region and in a second edge region of the primary induction coil than in a central region, in each case at least one auxiliary induction coil being arranged in the region of the first and of the second edge region of the primary induction coil.

4. Induction heating device according to claim 1, wherein the at least one auxiliary induction coil can be activated by being short-circuited.

5. Induction heating device according to claim 1, further comprising a control device for activating the at least one auxiliary induction coil.

6. Induction heating device according to claim 5, wherein the control device comprises a look-up table, in which the characteristic for the activation of the at least one auxiliary induction coil for at least one load case is stored.

7. Induction heating device according to claim 6, wherein the characteristic for the activation of the at least one auxiliary induction coil for at least one load case is determined empirically in advance and stored in the look-up table.

8. Induction heating device according to claim 5, further comprising at least one temperature sensor arranged in the area of the cylindrical body, the control device being designed in such a way that it permits the output signal from the at least one temperature sensor to be taken into account when activating the at least one auxiliary induction coil.

9. Processor for processing a recording medium, having an induction heating device, the induction heating device having a hollow cylindrical body made of electrically conductive material, at least one primary induction coil and at least one actively controlled auxiliary induction coil, the at least one primary induction coil and the at least one auxiliary induction coil being arranged in and around the cavity of the cylindrical body in such a way that, by means of the at least one primary induction coil, a first magnetic field can be produced in the cylindrical body and, by means of the at least one auxiliary induction coil, a second magnetic field can be produced in the cylindrical body, wherein the at least one auxiliary induction coil, and the at least one primary induction coil can be operated in such a way that the second magnetic field, at least in one region of the cylindrical body, counteracts the first magnetic field in such a way that the second magnetic field specifically weakens the first magnetic field to maintain a substantially uniform temperature profile on an outer surface of the cylindrical body.

10. Processor according to claim 9, further comprising:

transport means for transporting the recording medium through the processor;

exposure means, arranged relative to a predetermined section of the cylindrical body, for exposing the recording medium as it rests on this section; and pressing means for pressing the recording medium against the outer surface of the cylindrical body for its development.

11. Method of operating an induction heating device, which comprises a hollow cylindrical body made of electrically conductive material, at least one primary induction coil and at least one actively controlled auxiliary induction coil, the primary induction coil and the at least one auxiliary induction coil being arranged in and around the cavity of the cylindrical body, comprising the following steps:

a) producing a first magnetic field in the cylindrical body by means of the at least one primary induction coil;

b) producing a second magnetic field in the cylindrical body by means of the at least one auxiliary induction coil, wherein the second magnetic field, at least in one area of the cylindrical body, counteracts the first magnetic field in such a way that the second magnetic field specifically weakens the first magnetic field to maintain a substantially uniform temperature profile on an outer surface of the cylindrical body.

* * * * *